US006655979B1

(12) United States Patent
Lee

(10) Patent No.: US 6,655,979 B1
(45) Date of Patent: Dec. 2, 2003

(54) CABLE END CONNECTOR WITH LOCKING MEMBER

(75) Inventor: George Lee, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/271,064

(22) Filed: Oct. 15, 2002

(51) Int. Cl.[7] ..... H01R 13/677
(52) U.S. Cl. ..... 439/357
(58) Field of Search ..... 439/357, 358, 439/352, 353

(56) References Cited

U.S. PATENT DOCUMENTS 5,445,534 A 8/1995 Ishizuka et al. ..... 439/352
5,672,071 A 9/1997 Ceru ..... 439/383
5,775,931 A 7/1998 Jones ..... 439/358
5,924,887 A 7/1999 Aoyama et al. ..... 439/108
6,431,887 B1 8/2002 Yeomans et al. ..... 439/108

*Primary Examiner*—Tulsidas Patel
(74) *Attorney, Agent, or Firm*—Wei Te Chung

(57) ABSTRACT

A cable end connector (1) for mating with a complementary connector (7) comprises a housing (2) defining a receiving space (21) in a mating portion (20) thereof, a plurality of contacts (31) mounted in the housing, a cable (5) having a plurality of conductors (50) electrically connecting the contacts, a cover (4) over-molded with and enclosing a rear portion of the housing, and a locking member (6). The locking member has a pushing portion (61) abutting against a fulcrum portion (42) of the cover, a pair of side securing portions (64) extending forwardly from the pushing portion and securing to the mating portion of the housing, and a latching portion (63) extending forwardly from the pushing portion adapted for locking with the complementary connector and providing a mechanical connection therebetween.

22 Claims, 13 Drawing Sheets

CABLE END CONNECTOR WITH LOCKING MEMBER

CROSS-REFERENCE TO RELATED APPLICATION

This patent application is related to a application Ser. No. 10/241,551, filed on Sep. 11, 2002, invented by Jerry Wu, and entitled "CABLE END CONNECTOR WITH LOCKING MEMBER" and assigned to the same assignee as this patent application. This patent application is also related to a application Ser. No. 10/242,099, filed on Sep. 11, 2002, invented by Jerry Wu, and entitled "ELECTRICAL CONNECTOR WITH LOCKING MEMBER" and is also related to Ser. No. 10/280,515, filed on Oct. 24, 2002, invented by George Lee, entitled "CABLE END CONNECTOR WITH LOCKING MEMBER", both assigned to the same assignee as this patent application.

BACKGROUND OF THE INVENTION

1. Field of the Invention

The present invention relates to a cable end connector with a locking member for locking with a complementary connector.

2. Description of Related Art

Complementary electrical connectors typically include dielectric housings respectively receiving a plurality of terminals or contacts which, when the connectors are mated, establish an electrical interconnection therebetween. The complementary connectors may be male and female connectors or plug and socket connectors for electrically connecting the terminals or contacts received therein. In some instances, the connectors have complementary latches for locking the connectors together when mated. U.S. Pat. Nos. 5,445,534, 5,775,931, 5,924,886 and 6,431,887 disclose different forms of latch structures to provide reliable mechanical connection therebetween.

There exists in the art an electrical connector known as a Serial Advanced Technology Attachment (Serial ATA) connector which is generally used for disk drives and storage peripherals. Especially, the Serial ATA connectors according the Serial ATA standard are featured in fewer electrical contacts than other conventional electrical connectors and are relatively tiny in configurations, and it is more desirable for the Serial ATA connector to have a locking member for providing a reliable mechanical and electrical connection with a complementary connector.

Hence, an electrical connector with a locking member for locking the electrical connector with a complementary connector is required to overcome the disadvantages of the related art.

SUMMARY OF THE INVENTION

An object, therefore, of the present invention is to provide a cable end connector with a locking member for locking the connector with a complementary connector.

Another object of the present invention is to provide a cable end connector with a locking member adapted to easily lock/release with/from a complementary connector.

In order to achieve the objects set forth, a cable end connector for mating with a complementary connector comprises a housing defining a receiving space in a mating portion thereof adapted for receiving a mating portion of the complementary connector, a plurality of contacts mounted in the housing, a cable having a plurality of conductors electrically connecting the contacts, a cover over-molded with and enclosing a rear portion of the housing, and a locking member. The locking member has a pushing portion abutting against a fulcrum portion of the cover, a securing portion extending forwardly from the pushing portion and securing to the mating portion of the housing, and a latching portion extending forwardly from the pushing portion adapted for locking with the complementary connector and providing a mechanical connection therebetween.

Other objects, advantages and novel features of the invention will become more apparent from the following detailed description when taken in conjunction with the accompanying drawings.

DETAILED DESCRIPTION OF THE INVENTION

Figure 1:
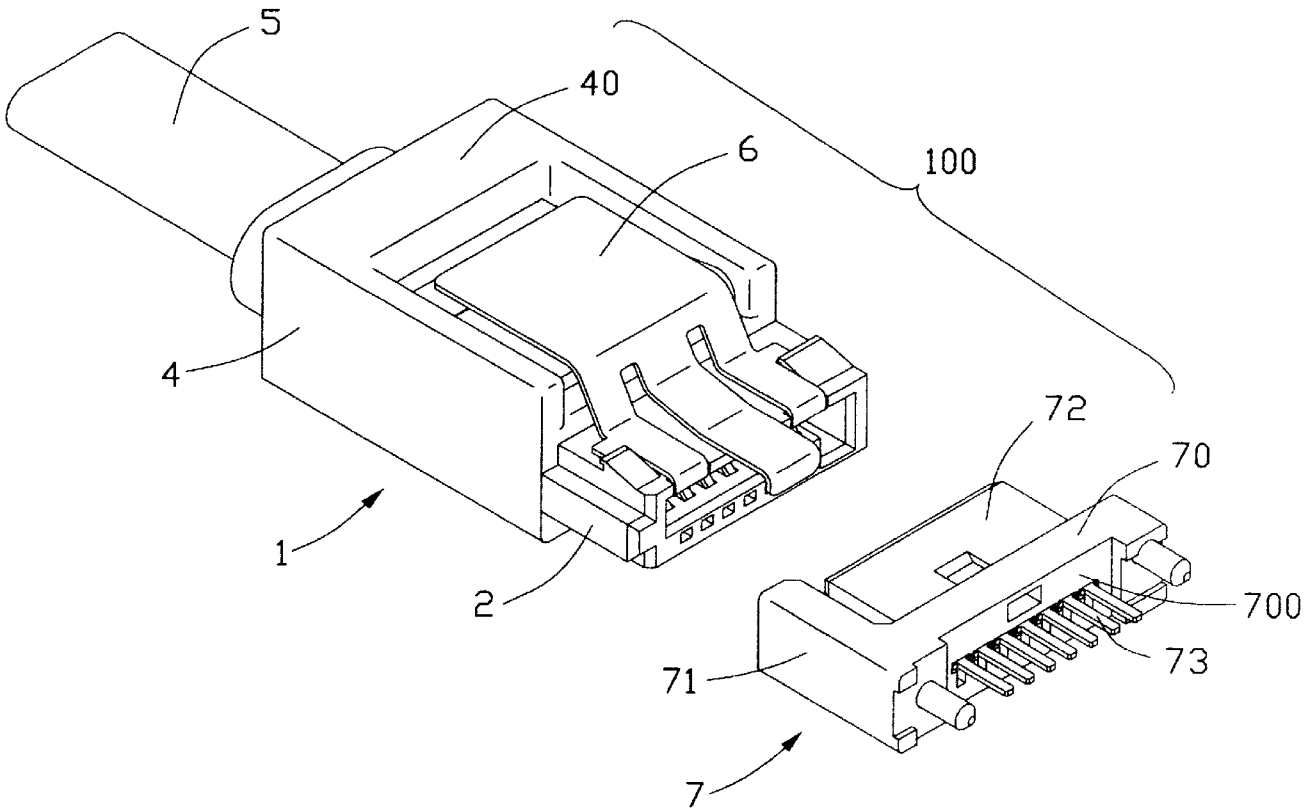
FIG. 1 is a perspective view of an electrical connector assembly to show a cable end connector and a complementary connector in accordance with the present invention.

Referring to FIG. 1, an electrical connector assembly 100 in accordance with the present invention comprises a cable end connector 1 and a complementary connector 7. In the embodiment shown, the cable end connector 1 and the complementary connector 7 are typical standard Serial ATA connectors. However, in alternative embodiments, the electrical connectors could be provided as other than Serial ATA electrical connectors.

Figure 2:
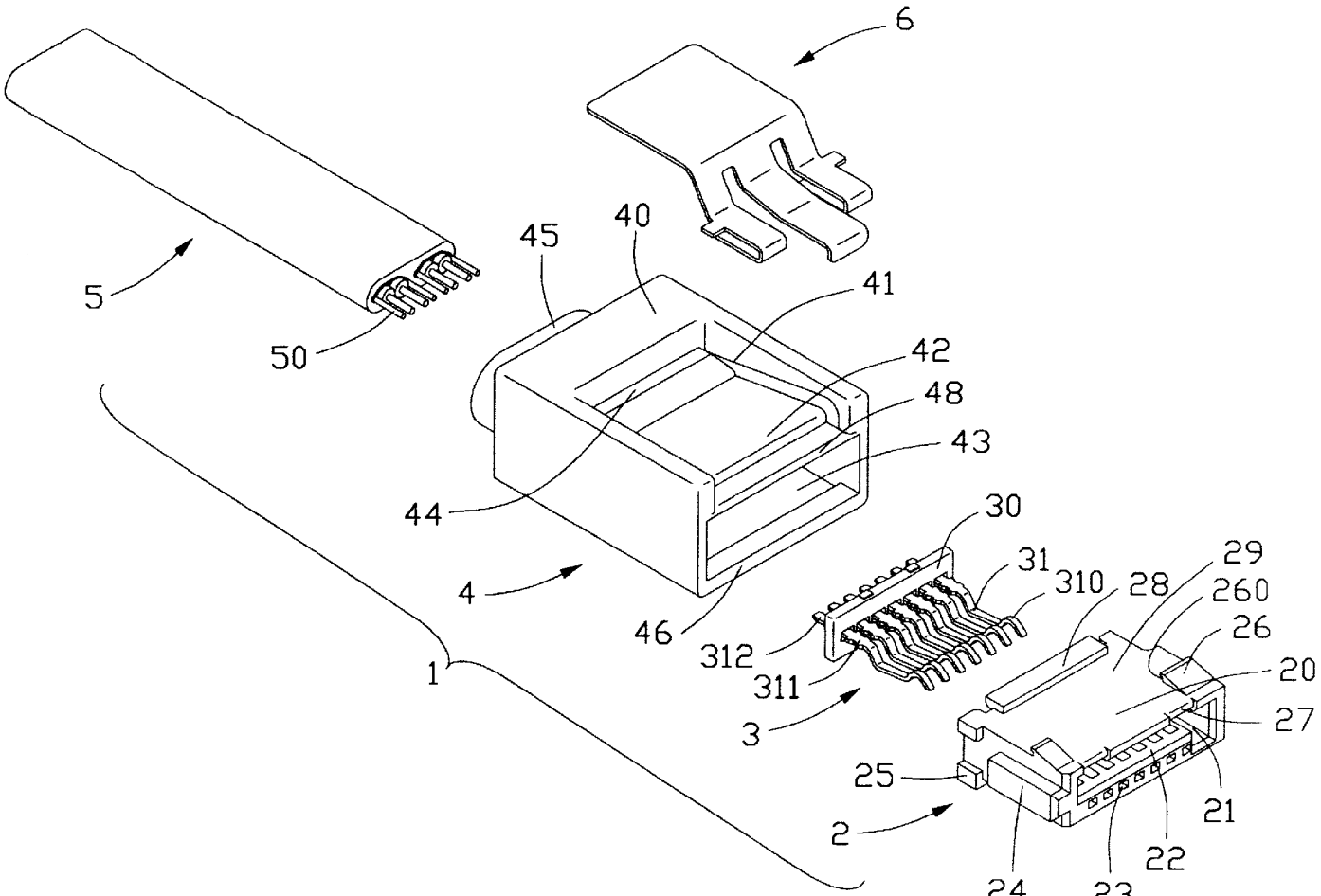
FIG. 2 is an exploded, perspective view of the cable end connector in accordance with the present invention.

Referring to FIG. 2, the cable end connector 1 comprises an insulative housing 2, a contact insert 3, a cover 4, a cable 5, and a locking member 6.

Figure 3:
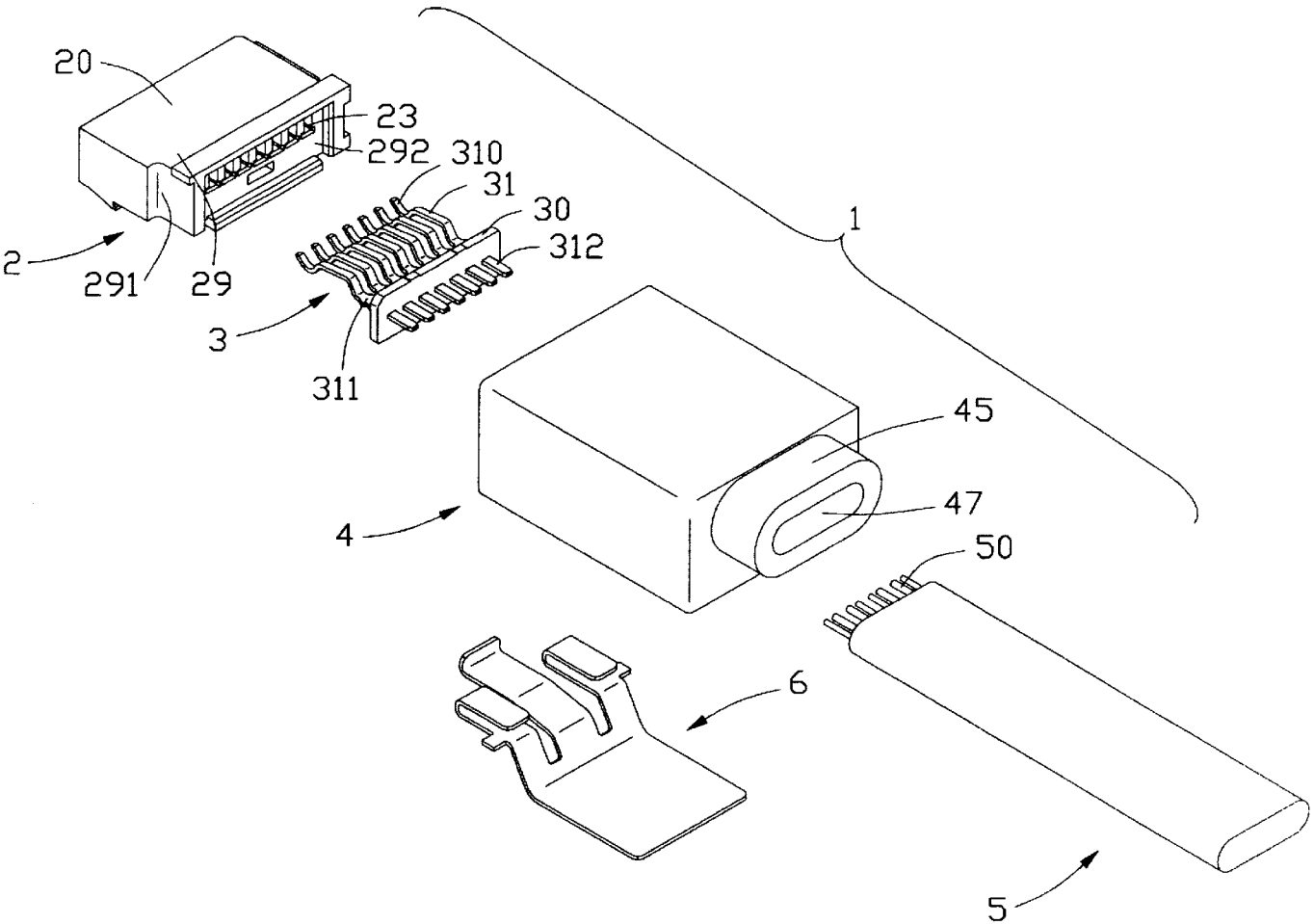
FIG. 3 is a view similar to FIG. 2, but taken from rear and bottom aspects.
Figure 4:
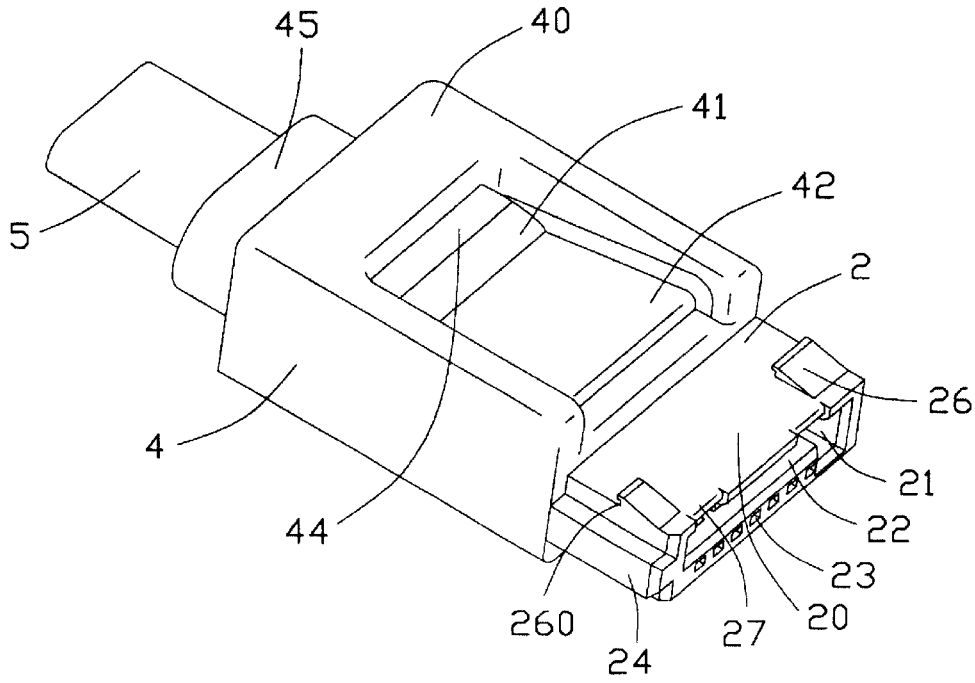
FIG. 4 is an assembled, perspective view of the cable end connector of FIG. 2, except for a locking member.
Figure 5:
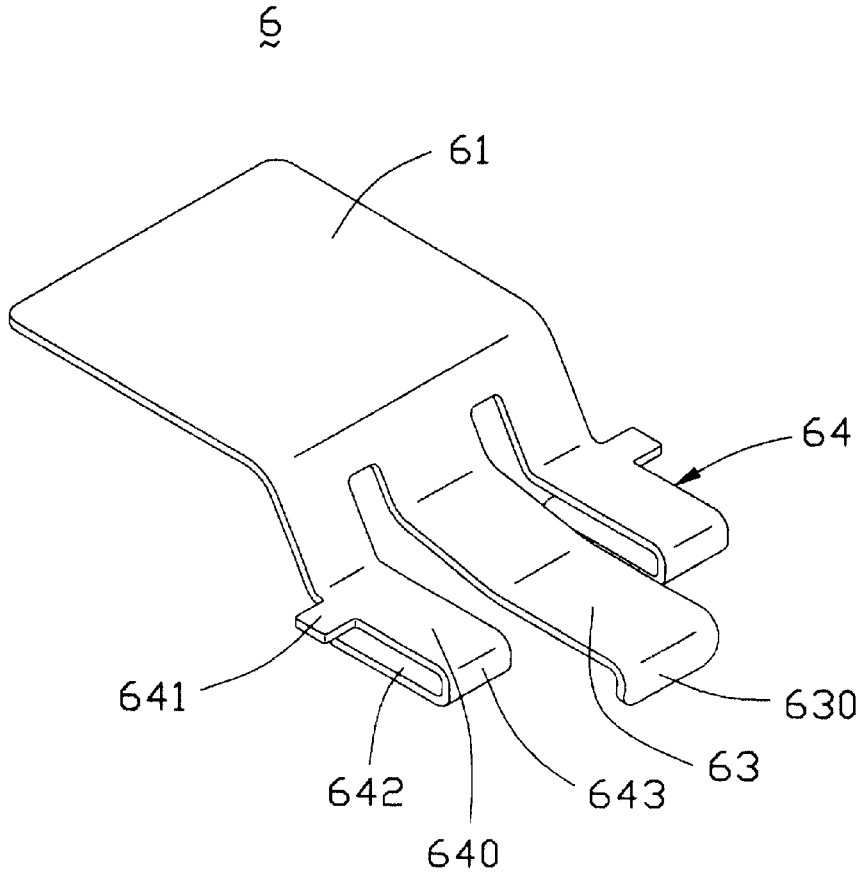
FIG. 5 is a perspective view of the locking member of the cable end connector.
Figure 6:
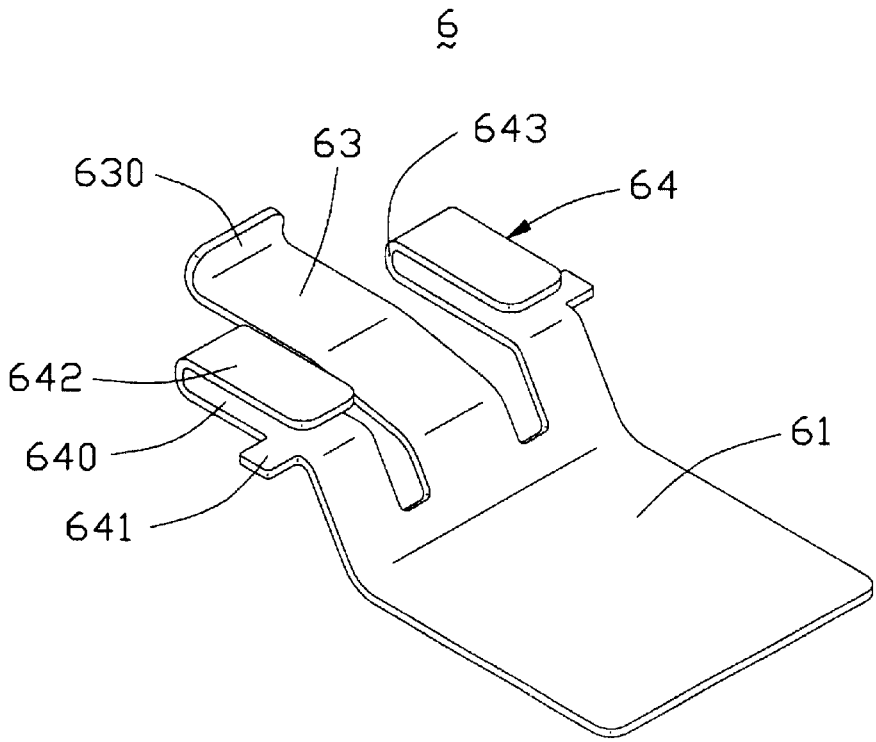
FIG. 6 is a view similar to FIG. 5, but taken from rear and bottom aspects.
Figure 7:
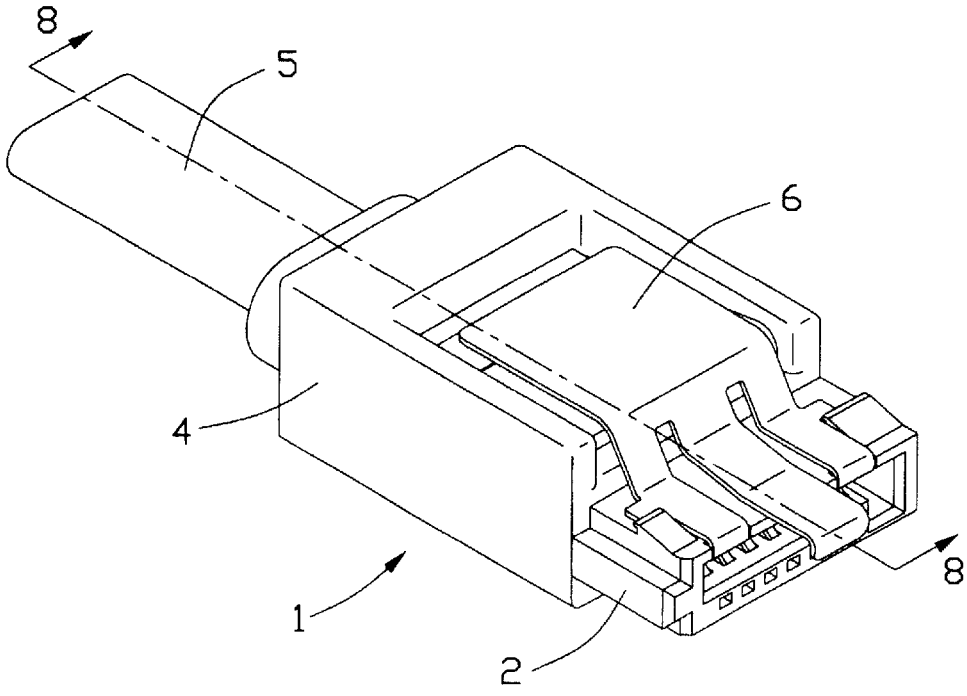
FIG. 7 is an assembled view of the cable end connector of FIG. 2.
Figure 8:
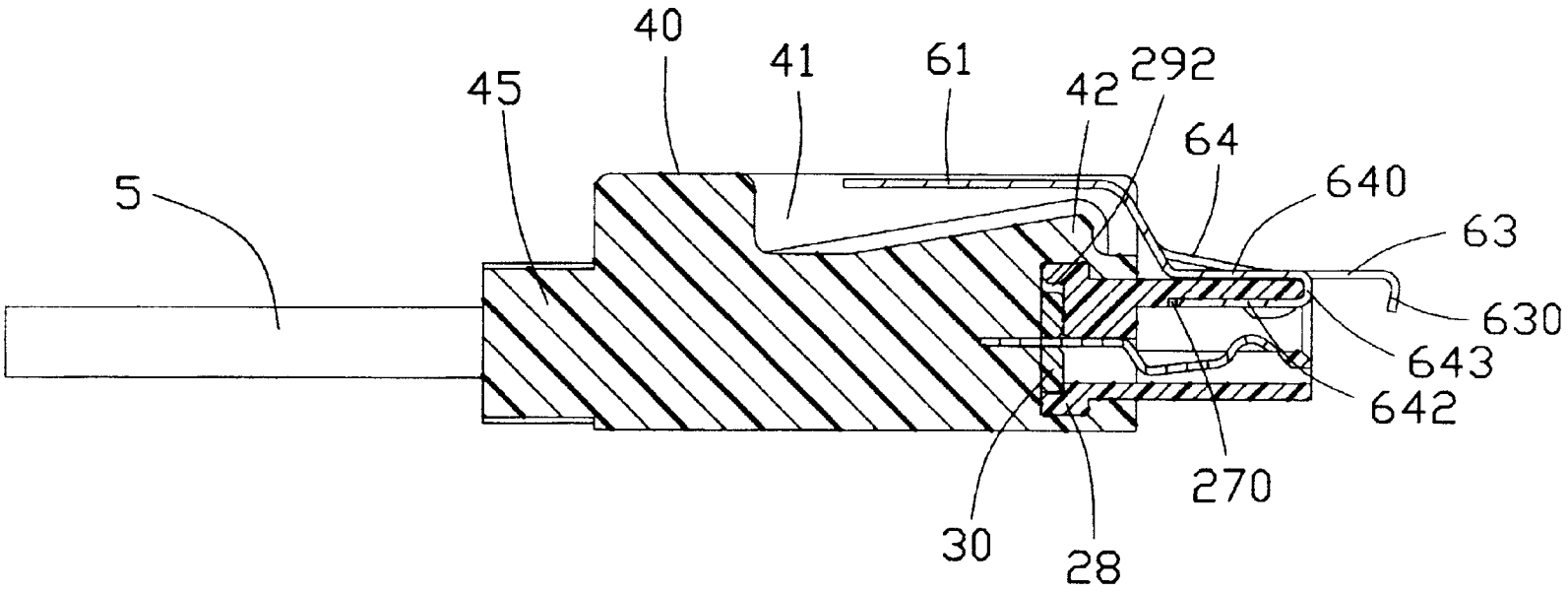
FIG. 8 is a cross-sectional view taken along line 8—8 of FIG. 7.

Referring to FIGS. 2–4 and in conjunction with FIGS. 7 and 8, the insulative housing 2 comprises a mating portion 20 and a rear portion 29 opposite to the mating portion 20. An L-shaped receiving space 21 is defined in the mating portion 20. A block 22 is formed on a lower wall of the mating portion 20 and protrudes into the receiving space 21.

A plurality of passageways 23 is defined through the block 22. A pair of ribs 28 is formed on an upper surface and a lower surface of the housing 2 and adjacent to the rear portion 29 thereof for engaging with the cover 4 and a receiving cavity 292 is defined in the rear portion 29. A guiding projection 24 protrudes sidewardly from a side surface of the housing 2. A pair of protrusions 25 protrudes sidewardly from the side surface of the housing 2 and adjacent to the guiding projection 24.

A pair of projections 26 forms on the upper surface of the housing 2 and a slit 260 is defined between the projection 260 and the upper surface of the housing 2. A cutout 291 is defined in the rear portion 29 of the housing 2 and opposite to the pair of protrusions 25 for being received into the cover 4. A pair of cutouts 27 is defined in a front edge of an upper wall of the mating portion 20, and a pair of recesses 270 is defined in an inner surface of the upper wall of the mating portion 20 and is in communication with the cutouts 27 respectively.

The contact insert 3 comprises a plurality of contacts 31 and a retainer 30 defining a plurality of slots therein. Each contact 31 comprises a retention portion 311 for engaging with corresponding passageway 23 defined in the block 22, a mating portion 310 extending forwardly from the retention portion 311 for being received in corresponding passageway 23 and partly exposed into the receiving space 21, and a tail portion 312 extending rearwardly from the retention portion 311 for electrically connecting the cable 5.

The cable 5 comprises a plurality of conductors 50 extending beyond a front end thereof.

The cover 4 is over-molded with the housing 2 and the cable 5. The cover 4 comprises a rectangular body and a rear portion 45 extending rearwardly from the body. The body comprises an upper plate 48 and a lower plate 46, and a receiving cavity 43 is defined therebetween for receiving the rear portion of the housing 2. The rear portion 45 of the cover 4 defines an opening 47 therethrough for receiving the front end of the cable 5. A channel 41 is defined in a front portion of the body and a holder portion 40 of the body is formed in a rear portion of the body. An inclined fulcrum portion 42 extends upwardly and forwardly from a bottom surface 44 of the channel 41 and into the channel 41.

Referring to FIGS. 2, 3, 5 and 6, the locking member 6 comprises a flat pushing portion 61, a pair of side securing portions 64 extending downwardly then forwardly from a front end of the pushing portion 61, and a latching portion 63 extending downwardly then forwardly from the pushing portion 61 and locating between the pair of the side securing portions 64. A hook portion 630 bends downwardly from a front end of the latching portion 63 for locking with the complementary connector 7. Each side securing portion 64 comprises an arm 640 for securing to the upper surface of the mating portion 20 of the housing 2, a bending portion 643 extending vertically from a free end of the arm 640 for engaging with corresponding cutout 27 of the mating portion 20, and a claw 642 extending rearwardly from a free end of the bending portion 643 for being received in corresponding recess 270 of the mating portion 20. A tab 641 extends sidewardly from an outer edge of each arm 640 for being received in corresponding slit 260 defined in the projection 26 of the housing 2.

Referring to FIGS. 1, 4, 7 and 8, in assembly, the contacts 31 is first assembled into the housing 2 in a rear-to-front direction. The mating portions 310 and the retention portions 311 of the contacts 31 are received into the passageways 23 and the tail portions 312 exposed outside the housing 2. The retainer 30 is pushed into and received in the receiving cavity 292 defined in the housing 2, and the tail portions 312 of the contacts 31 protrude through the slots of the retainer 30. The conductors 50 of the cable 5 are soldered to the tail portions 312 of the contacts 31. The cover 4 is then over-molded with the rear portion of the housing 2 with the conductors 50 received into the opening 47. The pair of ribs 28 is received in the receiving cavity 43 and engaging with inner surfaces of the upper and lower plates 48, 46. The pair of protrusions 25 is received in the receiving cavity 43 and engaging with an inner side surface of the body. The locking member 6 is then assembled to the housing 2 and the cover 4. The bending portions 643 of the pair of side securing portions 64 engage with the cutouts 27 defined in the mating portion 20. The claws 642 hook inwardly within the recesses 270 communicating with the cutouts 27 for attaching the locking member 6 firmly to the housing 2. Each tab 641 of the arm 640 is received in corresponding slit 260 defined in the projection 26 of the housing 2 for preventing the locking member 6 from moving forwardly. The pushing portion 61 is received in the channel 41 and the front end thereof abuts against the fulcrum portion 42 which can prevent the locking member 6 from being pushed too much and destroyed and function as a fulcrum. The latching portion 63 extends beyond the mating portion 20 of the housing 2 for locking with the complementary connector 7.

Figure 9:
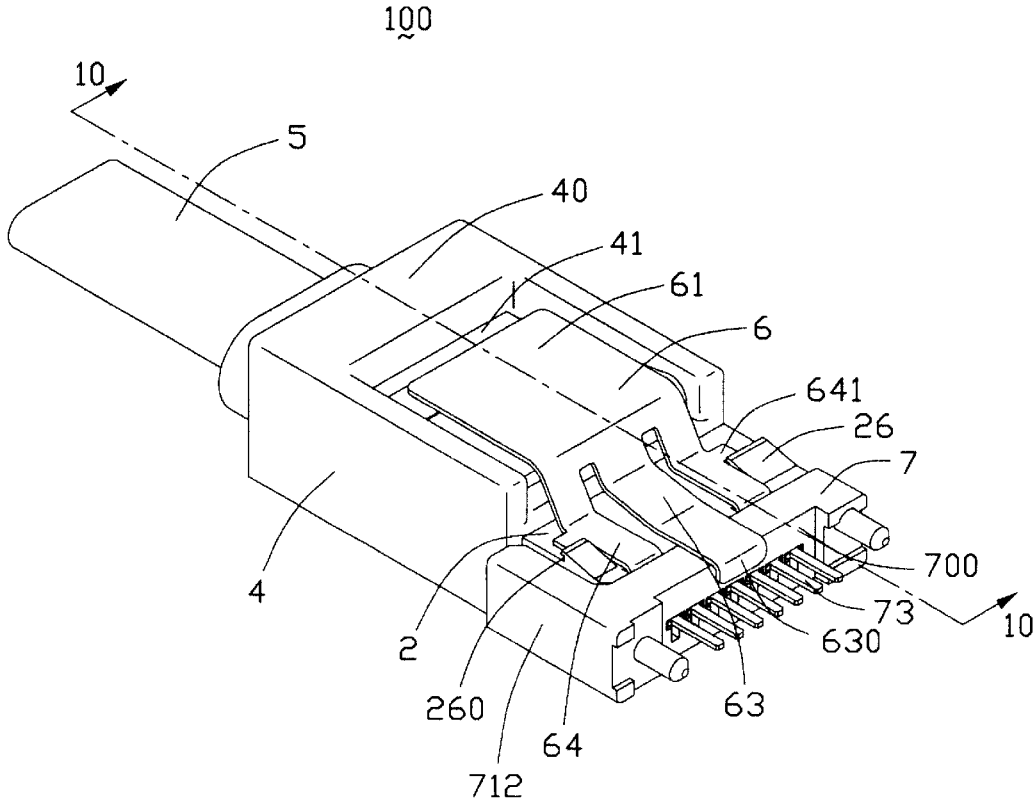
FIG. 9 is an assembled view of the cable end connector and the complementary connector of FIG. 1.
Figure 10:
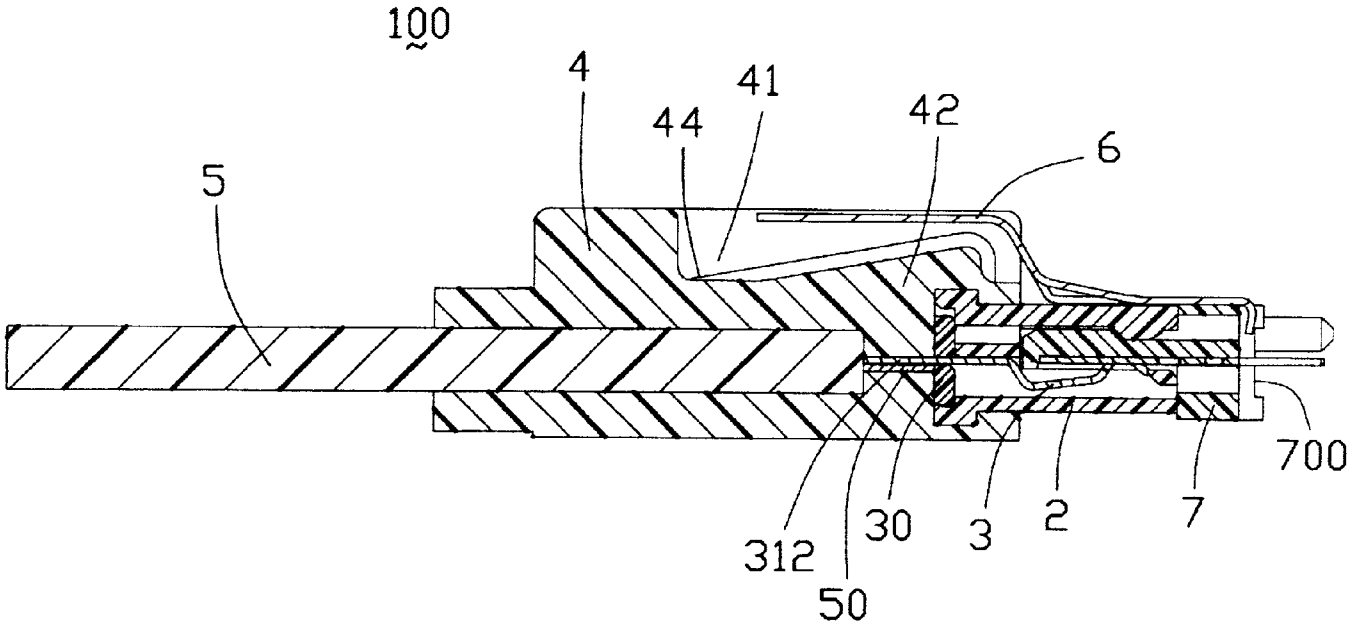
FIG. 10 is a cross-sectional view taken along line 10—10 of FIG. 9.

Referring to FIGS. 1, 9 and 10, the complementary connector 7 comprises a base portion 70, a guiding post 71 extending forwardly from one end of the base portion 70, a tongue portion 72 extending forwardly from a middle of the base portion 70. A plurality of terminals 73 is assembled to the tongue portion 72 and each terminal 73 has a tail portion extending beyond a rear surface 700 of the base portion 70 for extending through and soldered with a through hole of a printed circuit board (not shown).

When the cable end connector 1 is mated with the complementary connector 7, the guiding projection 24 of the cable end connector 1 is received into the guiding post 71 of the base portion 70 of the complementary connector 7, the tongue portion 72 is received into the receiving space 21 with the terminals 73 electrically contacting the contacts 31 exposed into the receiving space 21, the hook portion 630 of the locking member 6 locking and abutting against the rear surface 700 of the base portion 70 to securely lock the complementary connector 7 with the cable end connector 1. When the cable end connector 1 is separated from the complementary connector 7, push a rear end of the pushing portion 61 downwardly toward the channel 41, at the same time, push the holder portion 40 rearwardly. The fulcrum portion 42 of the cover 4 supports the pushing portion 61 and functions as a fulcrum, at the same time, the hook portion 630 of the latching portion 63 moves upwardly and are separated from the rear surface 700 of the base portion 70, the cable end connector 1 is separated from the complementary connector 7.

Figure 11:
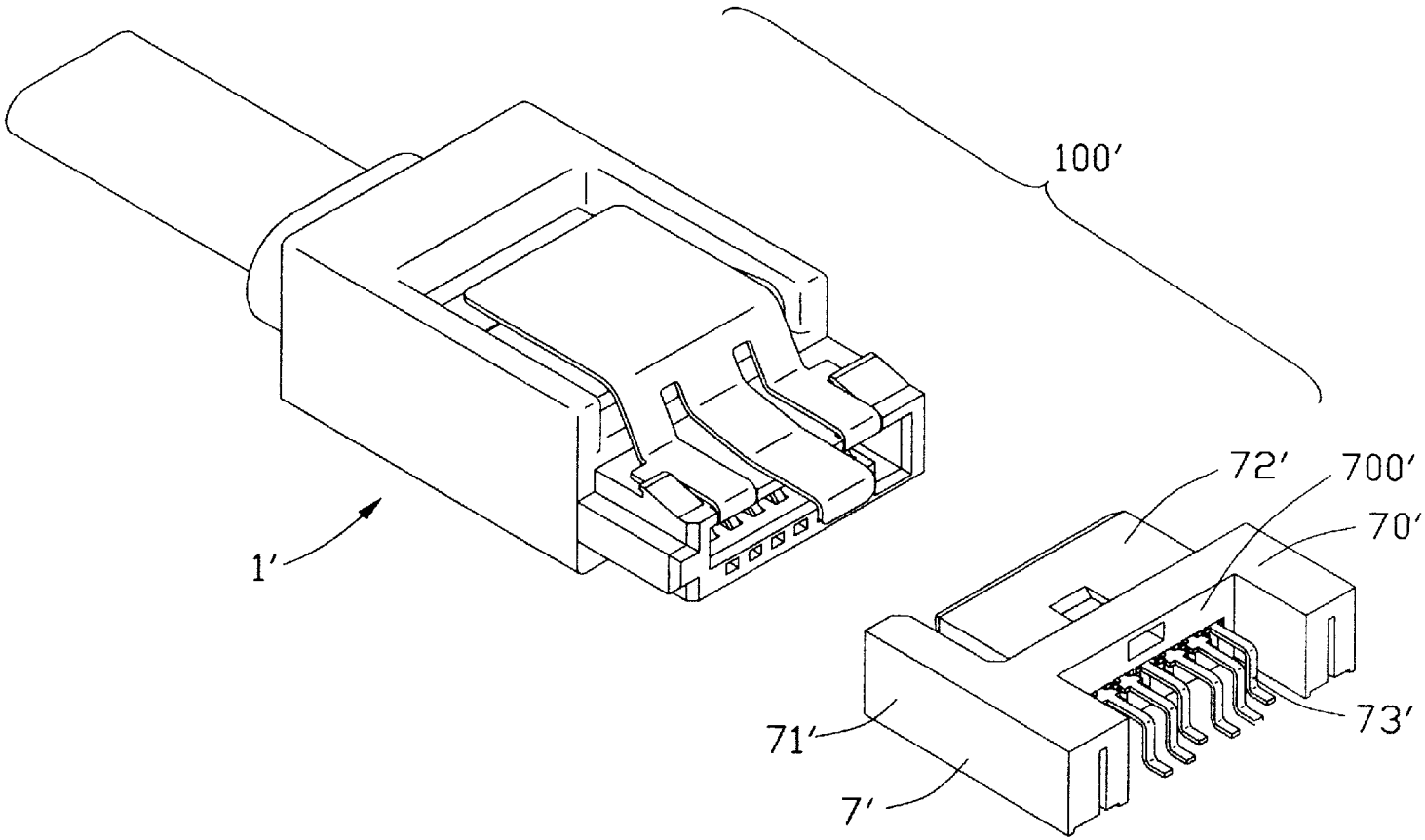
FIG. 11 is a perspective view of an electrical connector assembly of a second embodiment of the present invention to show a second cable end connector and a second complementary connector.
Figure 12:
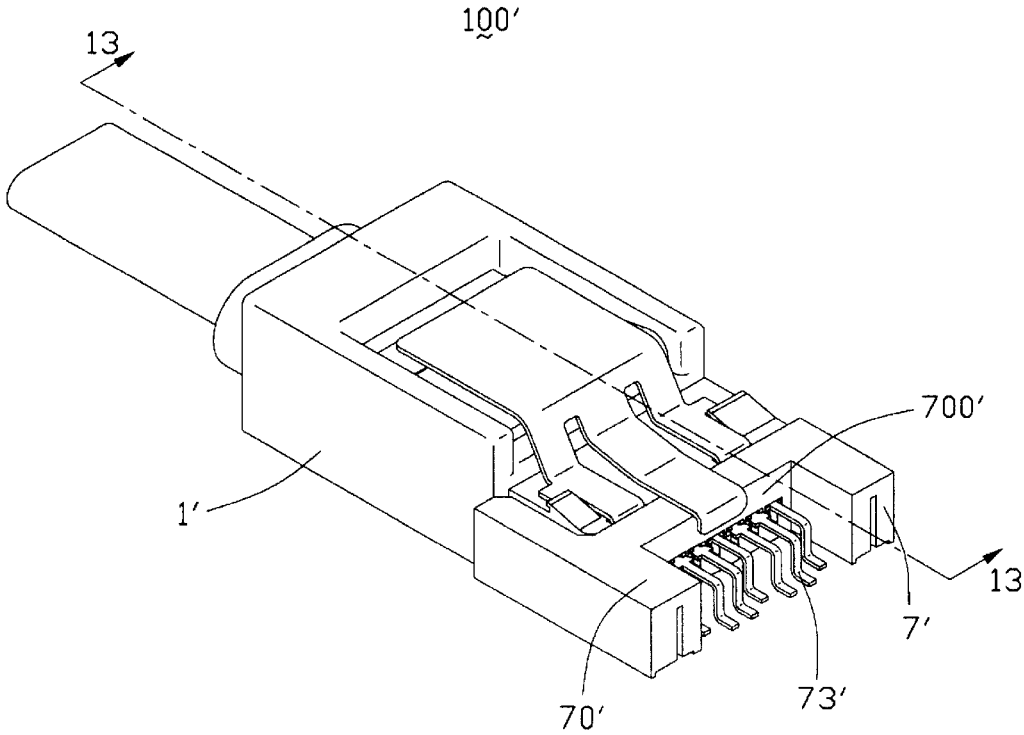
FIG. 12 is an assembled view of FIG. 11.
Figure 13:
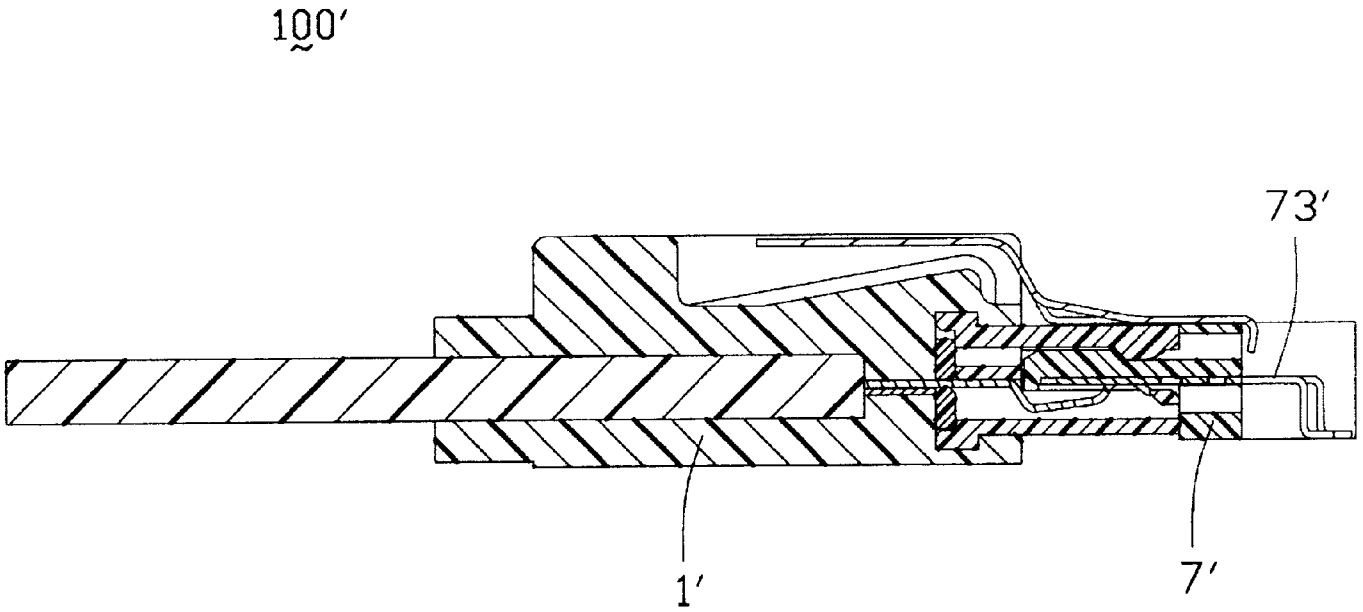
FIG. 13 is a cross-sectional view taken along line 13—13 of FIG. 12.

Referring to FIGS. 11–13, an electrical connector assembly 100' in accordance with a second embodiment comprises a second cable end connector 1' and a second complementary connector 7'. The second cable end connector 1' has a same construction as that of the cable end connector 1 described in the first embodiment. The second complementary connector 7' has a same construction as that of the complementary connector 7 in the first embodiment except a base portion 70' and terminals 73'. The base portion 70' has a pair of rear portions extending rearwardly from a rear surface 700' of the base portion 70'. Each terminal 73' has a tail portion extending beyond the rear surface 700' of the base portion 70' and is bent downwardly for being surface mounted to the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector for mating with a complementary connector, comprising:

an insulative housing defining a receiving space from a mating portion thereof adapted for receiving a mating portion of the complementary connector;

a plurality of contacts mounted in the housing;

a cable having a plurality of conductors electrically connecting the contacts;

a cover over-molded with and enclosing a rear portion of the housing; and a locking member having a pushing portion abutting against a fulcrum portion of the cover, a securing portion extending forwardly from the pushing portion and securing to the mating portion of the housing, and a latching portion extending forwardly from the pushing portion adapted for locking with the complementary connector and providing a mechanical connection therebetween.

2. The cable end connector as claimed in claim 1, wherein the securing portion of the locking member is a pair of side securing portions extending forwardly from a front end of the pushing portion.

3. The cable end connector as claimed in claim 2, wherein each side securing portion comprises an arm securing to an upper surface of the mating portion of the housing, a bending portion extending vertically from a free end of the arm and a claw extending rearwardly from a free end of the bending portion.

4. The cable end connector as claimed in claim 3, wherein a pair of cutouts is defined in an edge of a side wall of the mating portion and a pair of recesses is defined in an inner surface of the side wall of the mating portion and in communication with the cutouts respectively, the bending portions of the side securing portions are received in the cutouts and the claws are received in the recesses.

5. The cable end connector as claimed in claim 4, wherein a pair of projections is formed on the upper surface of the housing and a slit is defined between the projection and the upper surface, each arm of the side securing portion comprises a tab extending sidewardly from an outer edge thereof and is received in the slit.

6. The cable end connector as claimed in claim 4, wherein the latching portion locates between the pair of side securing portions and extends beyond the mating portion of the housing.

7. The cable end connector as claimed in claim 6, wherein the latching portion comprises a hook portion bending downwardly from a front end thereof adapted for locking with the complementary connector.

8. The cable end connector as claimed in claim 1, wherein the receiving space of the housing has an L-shape.

9. The cable end connector as claimed in claim 8, wherein the housing further comprises a block on another side wall thereof and protrudes into the receiving space, a plurality of passageways is defined therethrough for receiving the contacts therein.

10. The cable end connector as claimed in claim 1, wherein the cover defines a channel in a front portion thereof and the inclined fulcrum portion extends upwardly and forwardly from a bottom surface of the channel and into the channel, the front end of the pushing portion of the locking member abuts against the fulcrum portion, the cover forms a holder portion in a rear portion thereof adapted for being pushing rearwardly when the cable end connector is separated from the complementary connector.

11. The cable end connector as claimed in claim 1, wherein the plurality of contacts is insested into the. passageways of the housing in a rear-to-front direction, and a retainer is assembled to the contacts to form a contact insert and is received in a receiving cavity defined in the rear portion of the housing.

12. The cable end connector as claimed in claim 9, wherein each contact comprises a retention portion engaging with corresponding passageway defined in the block of the housing, a mating portion extending forwardly from the retention portion and received in corresponding passageway adapted for mating with the complementary connector, and a tail portion extending rearwardly from the retention portion and exposed outside the housing for connecting the conductors of the cable.

13. The cable end connector as claimed in claim 1, wherein the housing comprises a guiding projection protruding sidewardly from a side surface of the housing adapted for complementing with a corresponding guiding portion of the complementary connector.

14. The cable end connector as claimed in claim 1, wherein the cover comprises an upper plate and a lower plate, a receiving cavity is defined therebetween, the housing comprises a pair of ribs formed on the upper surface and a lower surface thereof and adjacent to the rear portion for engaging with inner surfaces of the upper and lower plates of the cover.

15. The cable end connector as claimed in claim 13, wherein the housing comprises a pair of protrusions protruding sidewardly from the side surface of the housing and adjacent to the guiding projection for engaging with an inner side surface of the cover.

16. An electrical connector assembly adapted for being mounted on a printed circuit board, comprising:

a cable end connector comprising a housing defining a receiving space from a mating portion thereof, a plurality of contacts mounted in the receiving space, a cable having a plurality of conductors electrically connecting the contacts, a cover enclosing a rear portion of the housing, and a locking member having a pushing portion abutting against a fulcrum portion of the cover, a securing portion extending forwardly from the pushing portion and securing to the mating portion of the housing, and a latching portion extending forwardly from the pushing portion;

a complementary connector having a base portion and a tongue portion extending forwardly from the base portion and respectively received into the receiving space of the cable end connector, a plurality of terminals received into the tongue portion and respectively electrically contacting the contacts of the cable end connector;

wherein the latching portion of the locking member locks with the base portion of the complementary connector for providing a mechanical connection between the cable end connector and the complementary connector.

17. The electrical connector assembly as claimed in claim 16, wherein the securing portion is a pair of side securing portions extending forwardly from the front end of the pushing portion.

18. The electrical connector assembly as claimed in claim 16, wherein the latching portion locks and abuts against a rear surface of the base portion of the complementary connector.

19. The electrical connector assembly as claimed in claim 16, wherein the cable end connector comprises a guiding projection protruding from a side surface of the housing, the base portion of the complementary connector has a guiding post locating at a side thereof, the guiding projection is respectively received into the guiding post.

20. An electrical connector assembly comprising:

a cable end connector comprising:

a first insulative housing defining a front-to-back direction and a lateral direction perpendicular to said front-to-back direction, a first mating port formed in a front portion thereof;

a cover essentially located around a rear portion of said insulative first housing;

a plurality of first contacts disposed in the first housing and communicating with said first mating port;

a receptacle connector including a second insulative housing defining a second mating port with a plurality of second contacts therein;

said first housing and said second housing head to head engaged with each other with said first mating port and said second mating port mated with each other;

a locking member located in an area of said first connector and essentially on a plane defined by said lateral direction and said front-to-back, said locking member including a fastening section about the first mating port of the first housing with a pushing section located around a rear portion of the cover and a latching section extending forwardly beyond the first mating port to latchably engage a rear portion of the second housing.

21. The electrical connector assembly as claimed in claim 20, wherein said fastening section is of a U-shaped configuration directly confronting and facing the second mating port.

22. The electrical connector assembly as claimed in claim 20, wherein said locking member is assembled to the first housing along a front-to-back direction of the said first housing.

* * * * *